United States Patent [19]

Nevoral

[11] Patent Number: 4,878,668

[45] Date of Patent: Nov. 7, 1989

[54] INDOOR HOCKEY PUCK

[76] Inventor: Victor Nevoral, 1189B Baity Avenue, Quesnel, British Columbia, Canada, V2J 5G5

[21] Appl. No.: 38,324

[22] Filed: Apr. 14, 1987

[30] Foreign Application Priority Data

Apr. 14, 1986 [CA] Canada ..... 506564

[51] Int. Cl.[4] ..... A63B 71/00

[52] U.S. Cl. ..... 273/128 R

[58] Field of Search ..... 273/128 R, 128 CS, 128 A, 273/106 R

[56] References Cited

U.S. PATENT DOCUMENTS

| | | | |
|---|---|---|---|
| 2,640,699 | 6/1953 | Garbo | 273/128 R |
| 3,887,188 | 6/1975 | Beuchamp | 273/128 R |
| 4,078,801 | 3/1978 | White, Sr. | 273/128 R |
| 4,153,253 | 5/1979 | White, Sr. | 273/128 R |
| 4,555,114 | 11/1985 | Dozier | 273/128 R |

*Primary Examiner*—T. Brown

*Attorney, Agent, or Firm*—John R. Uren

[57] ABSTRACT

A floor hockey puck has a generally cylindrical configuration. A felt-like layer is carried between two oppositely located, leather-like end discs and stitching is used to connect the end discs to the felt-like central layer.

6 Claims, 1 Drawing Sheet

INDOOR HOCKEY PUCK

INTRODUCTION

This invention relates to a floor hockey puck and, more particularly, to an improved floor hockey puck which is intended to be used primarily indoors.

BACKGROUND OF THE INVENTION

In countries where winter is a significant season, ice hockey is a popular sport. Because of the rigorous Physical activity involved in playing the sport, combined with the co-ordination necessary to excel, it is also a favoured activity for fitness purposes and, in particular, for fitness activities involving school children. However, the vagaries of the outside ice conditions, coupled with time constraints in physical education classes and the outside weather often dictate that the hockey be played inside. As such, indoor floor hockey has evolved to a popular sport and fitness activity in its own right.

The pucks presently used in floor hockey are typically, plastic-like pucks of the same general dimensions as an ice hockey puck. These plastic pucks, while being durable, do not properly simulate the motion of an ice hockey puck, they leave the floor frequently when struck by a stick, they are non-deformable and hard and therefore sting when hitting people which can cause apprehension and an outright refusal to play by the participants. Other pucks have also been used in various configurations and of various other materials but they all suffer from disadvantages similar to those mentioned.

SUMMARY OF THE INVENTION

According to the invention, there is disclosed a floor hockey puck in the form of a cylindrical disc, said Puck comprising an inner layer means having substantiallY felt-like characteristics and two outer disc means having substantially leather-like characteristics, said two outer disc means sandwiching said inner layer means therebetween and attachment means to connect the outer disc means to said inner layer means, the outside circumference of said inner layer means being substantially coincident with the outside circumference of each of said disc means.

BRIEF DESCRIPTION OF THE SEVERAL VIEWS OF THE DRAWINGS

A specific embodiment of the invention will now be described, by way of example only, with reference to the accompanying drawings in which.

DESCRIPTION OF SPECIFIC EMBODIMENT

Figure 1:
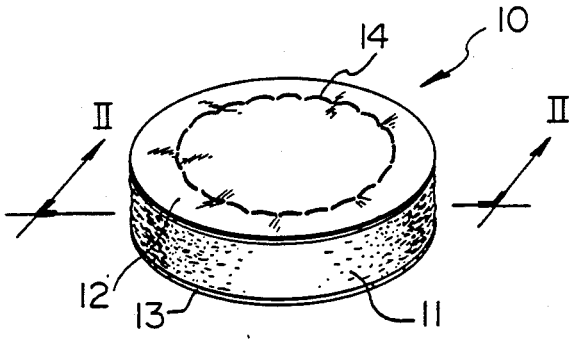
FIG. 1 is an isometric view of the floor hockey puck according to the invention.
Figure 2:
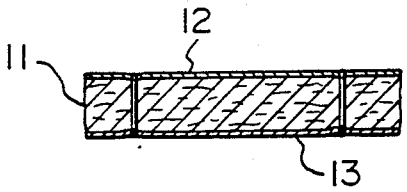
FIG. 2 is a sectional view taken along the plane II—II of FIG. 1.

Referring now to the drawings, the floor hockey puck according to the invention is generally shown at 10 in FIG. 1. It comprises a felt inner layer 11 sandwiched by two relatively thin leather discs 12, 13 located on opposite sides of the felt inner layer 11. The circumferences of the felt inner layer 11 and the oppositely located discs are generally similar and have the same general diameter as a regular ice hockey puck, namely about 70–75 mm. The Puck also has approximately 25 mm.

Stitching 14 is used to fasten the outer leather disc 12 to the felt inner layer 11 as illustrated. The stitching used can be, for example, waxed or nylon thread. The distance of the stitching from the circumference of the puck is approximately 8 mm. as illustrated in FIG. 1. The stitching length of approximately 10 mm. as illustrated has also been found to be suitable.

The thickness of the felt layer is approximately 20 mm and leather having a weight of approximately 4 to 6 oz./square foot has been found satisfactory as material for the outer discs which sandwich the felt inner layer 11.

While the materials disclosed and the dimensions given in the specific embodiment have resulted in a very suitable floor hockey Puck with the desirable attributes of lightness, softness, smooth operation on floors and durability, it is clear that other materials having similar characteristics to the felt and leather disclosed would also fall within the scope of the invention. For example, leather-like simulated material such as vinyl could be used for the two disc-like covers 12 and 13 and a felt-like simulated material could be used to replace the actual felt layer 11 specified. The combination of a number of pieces of leather or felt or similar material could also be used rather than the single pieces described. Insofar as the stitching specified is nylon, which stitching is used to connect the disc covers and the felt layer, other stitching or fastening means could also be used. Stitching or other soft connection means, however, is preferable as narrow hard portions are not present in the floor hockey puck according to the invention and the absence of hard areas is desirable to prevent injury.

In respect of the dimensions given, it is clear that even substantial dimensional changes can be made, either for efficient manufacture or other purposes which will not adversely affect the desirable characteristics of the puck when in operation. The dimensions of the floor hockey puck given above, however, have proven to provide excellent handling and wear characteristics.

Many other modifications may be made to the specific embodiment of the invention described and such description should be taken as illustrative only and not as limiting the scope of the invention as defined in accordance with the accompanying claims.

I claim:

1. A floor hockey puck in the form of a cylindrical disc having the size and shape of a conventional hockey puck, said puck having an inner relatively thick layer of felt material and two outer relatively thin cylindrical discs of leather material, said inner layer being substantially continuous throughout its volume between said two outer discs, and means connecting each of said outer discs to opposite flat sides of said inner layer.

2. A floor hockey puck as in claim 1 wherein the outside circumference of said inner layer is substantially coincident with the outside circumference of said outer discs.

3. A floor hockey puck as in claim 2 wherein said attachment means is thread.

4. A floor hockey puck as in claim 3 wherein said thread is in the form of stitching extending circumferentially around the outside circumference of said two outer discs, said stitching being located apProximately 8mm from said outside circumference.

5. A floor hockey puck as in claim 2 wherein said cylindrical disc has a diameter of approximately 70–75 mm.

6. A floor hockey puck as in claim 11 wherein the thickness of the puck is approximately 25 mm.

* * * * *

UNITED STATES PATENT AND TRADEMARK OFFICE

CERTIFICATE OF CORRECTION

PATENT NO. : 4,878,668

DATED : November 7, 1989

INVENTOR(S) : NEVORAL, Victor

It is certified that error appears in the above-identified patent and that said Letters Patent is hereby corrected as shown below:

In the Claims:

Claim 6, line 1 (Column 2, line 66), change "11" to --1--.

Signed and Sealed this

Nineteenth Day of March, 1991

*Attest:*

HARRY F. MANBECK, JR.

*Attesting Officer*

*Commissioner of Patents and Trademarks*